United States Patent [19]

Osberghaus et al.

[11] 4,404,039

[45] Sep. 13, 1983

[54] CLEANSER FOR ANODIZED SURFACES OF ALUMINUM AND ALLOYS THEREOF AND METHOD FOR USING SAME

[75] Inventors: Rainer Osberghaus, Düsseldorf; Hans Ellwanger, Leichlingen; Horst Marsen, Kerpen; Harald Bossek, Düsseldorf, all of Fed. Rep. of Germany

[73] Assignee: Henkel Kommanditgesellschaft auf Aktien, Düsseldorf-Holthausen, Fed. Rep. of Germany

[21] Appl. No.: 373,295

[22] Filed: Apr. 29, 1982

[30] Foreign Application Priority Data

May 16, 1981 [DE] Fed. Rep. of Germany ..... 3119538

[51] Int. Cl.[3] ..... C23G 1/06; C25D 11/18

[52] U.S. Cl. ..... 134/3; 134/28; 134/41; 252/79.4; 252/101; 252/136

[58] Field of Search ..... 252/136, 101, 79.4; 134/3, 28, 41

[56] References Cited

U.S. PATENT DOCUMENTS

| | | | |
|---|---|---|---|
| 3,004,879 | 10/1961 | Whitby . | |
| 3,645,790 | 2/1972 | Burden et al. | 134/3 |
| 3,663,327 | 5/1971 | Ritzi | 134/41 X |
| 3,738,937 | 6/1973 | Kautsky | 134/3 X |
| 3,932,243 | 1/1976 | Chang et al. | 252/79.4 X |
| 4,169,068 | 9/1979 | Harita et al. | 134/3 X |

FOREIGN PATENT DOCUMENTS

| | | |
|---|---|---|
| 2436278 | 2/1976 | Fed. Rep. of Germany . |
| 2621573 | 8/1978 | Fed. Rep. of Germany . |

OTHER PUBLICATIONS

*Chemical Abstracts*, vol. 88, (1978), p. 310, 175223u.

*Primary Examiner*—Robert L. Lindsay, Jr.
*Attorney, Agent, or Firm*—Hammond & Littell, Weissenberger and Muserlian

[57] ABSTRACT

This invention relates to an improved process for cleaning an anodized surface of aluminum or an alloy thereof where a cleaning agent is applied to the anodized surface and then the cleaning agent is removed after a sufficient period of contact, wherein the improvement comprises applying to the anodized surface at ambient temperature a thin film of a cleaning composition comprising an acid solution consisting essentially of:

(a) from about 3 to 30 percent by weight, based upon the total weight of the acid solution, of nitric acid, calculated as a 65% aqueous solution;

(b) from about 0.1 to 20 percent by weight, based upon the total weight of the acid solution, of partial esters of phosphoric acid;

(c) from about 0.3 to 30 percent by weight, based upon the total weight of the acid solution, of a phosphonocarboxylic acid with complexing action;

(d) from about 0.5 to 30 percent by weight, based upon the total weight of the acid solution, of nonionic and/or anionic tensides;

(e) from 0 to about 30 percent by weight, based upon the total weight of the acid solution, of solubilizers and/or organic solvents; and (f) from about 40 to 90 percent by weight, based upon the total weight of the acid solution, of water, said solution having a pH of less than 2, and then rinsing off the cleaning composition with water.

15 Claims, No Drawings

CLEANSER FOR ANODIZED SURFACES OF ALUMINUM AND ALLOYS THEREOF AND METHOD FOR USING SAME

FIELD OF THE INVENTION

This invention is directed to a cleanser for anodized surfaces of aluminum and alloys thereof. More particularly, this invention is directed to an improved cleanser for anodized surfaces of aluminum and alloys thereof which comprises an acid solution containing nitric acid, partial esters of phosphoric acid, and a phosphonic or phosphonocarboxylic acid with complexing action.

BACKGROUND OF THE INVENTION

Anodizing produces thin layers of aluminum oxide on the surface of aluminum or alloys thereof. These surfaces are then made tight in the manufacturing process, usually by treating with boiling water, to close the pores of the surfaces. The aluminum or aluminum alloy surfaces treated by this method are very hard and are protected against weathering.

Such anodized aluminum or aluminum alloy surfaces frequently find practical application because of their highly protective effect and attractive appearance, especially for exterior use. For example, large-area aluminum parts with anodized surfaces often are used to cover outside walls of buildings.

Neutral cleansers are recommended for the cleaning of anodized surfaces of aluminum and its alloys since alkaline cleansers readily attack or corrode the metal surface of the aluminum.

The cleaning action of neutral cleansers without abrasives is frequently inadequate, particularly in the construction field, for the cleaning of badly soiled metal facades of aluminum or similar material. When neutral cleansers with a content of abrasives are used, the desired cleaning effect may be obtained, but this method is quite time-consuming and expensive.

Phosphoric acid esters with short chains have been suggested as acid cleanser components with little corrosive action. However, without a mechanical boost, even these types of materials only remove superficially attached soils.

Finally, acid cleansers for anodized aluminum surfaces are known from German published application (DE-AS) No. 27 21 573. These agents consist of an acid treatment solution having a pH in the range of from 0.8 to 3 and contain complex fluorine-containing compounds of boron, aluminum, silicon, titanium, or zirconium, which compounds are used either singly or as a mixture. A good cleaning effect is obtained and no measurable attack on the oxide layer is observed after a contact period lasting up to five minutes.

However, considerably longer times of contact with the cleanser during the cleaning of building facades, particularly on less accessible elements of such facades, is unavoidable. A cleaning method that allows the removal of relatively strong soiling from metal facades with less expenditure than is required for abrasive cleaning and without corrosion of the facade material upon longer contact with the cleanser thus would offer considerable advantages for practical use.

OBJECTS OF THE INVENTION

It is an object of the invention to provide an improved method for cleaning anodized surfaces of aluminum and alloys thereof and a cleanser thereof.

It is also an object of the invention to provide a method for cleaning anodized surfaces of aluminum and alloys thereof which comprises contacting said surfaces with an acid solution comprising (a) from about 3 to 30, preferably from about 5 to 20, percent by weight, based upon the total weight of the acid solution, of nitric acid, calculated as a 65% aqueous solution;

(b) from about 0.1 to 20, preferably from about 0.2 to 10, percent by weight, based upon the total weight of the acid solution, of partial esters of phosphoric acid;

(c) from about 0.3 to 30, preferably from about 0.5 to 20, percent by weight, based upon the total weight of the acid solution, of a phosphonic acid or phosphonocarboxylic acid with complexing action;

(d) from about 0.5 to 30, preferably from about 1 to 20, percent by weight, based upon the total weight of the acid solution, of nonionic and/or anionic tensides;

(e) from 0 to about 30, preferably from 0 to about 20, percent by weight, based upon the total weight of the acid solution, of solubilizers and/or organic solvents; and (f) from about 40 to 90, preferably from about 49 to 80, percent by weight, based upon the total weight of the acid solution, of water, said solution having a pH of less than 2.

These and other objects of the invention will become more apparent in the discussion below.

DETAILED DESCRIPTION OF THE INVENTION

Applicants have developed a method of cleaning anodized surfaces of aluminum and alloys thereof, and a cleanser therefor, which meets the requirements set forth above. According to the invention, an aqueous acid solution is applied at ambient temperature as a thin film to an anodized surface of aluminum or an alloy thereof, and, after sufficient action, the solution is rinsed off with water. The acid solution used as the cleanser, or cleaning agent, comprises:

(a) from about 3 to 30, preferably from about 5 to 20, percent by weight, based upon the total weight of the acid solution, of nitric acid, calculated as as 65% aqueous solution;

(b) from about 0.1 to 20, preferably from about 0.1 to 10, percent by weight, based upon the total weight of the acid solution, of partial esters of phosphoric acid;

(c) from about 0.3 to 30, preferably from about 0.5 to 20, percent by weight, based upon the total weight of the acid solution, of a phosphonic acid or phosphonocarboxylic acid with complexing action;

(d) from about 0.5 to 30, preferably from about 1 to 20, percent by weight, based upon the total weight of the acid solution, of nonionic and/or anionic tensides;

(e) from 0 to about 30, preferably from 0 to about 20, percent by weight, based upon the total weight of the acid solution, of solubilizers and/or organic solvents; and (f) from about 40 to 90, preferably from about 49 to 80, percent by weight, based upon the total weight of the acid solution, of water, said solution having a pH of less than 2.

Advantageously nitric acid is used as a 65% aqueous solution. The partial esters of phosphoric acid are mixtures of mono- and diphosphoric acid esters. Such products can be prepared by the reaction of phosphoric acid with aliphatic alcohols, preferably alkanols, having from 1 to 3 carbon atoms.

Numerous phosphonic acids and phosphonocarboxylic acids with complexing properties are known and would be useful according to the invention. Suitable phosphonic acids include 1-hydroxyalkane-1,1-diphosphonic acids having from 1 to 8 carbon atoms in the alkane moiety, particularly 1-hydroxyethane-1,1-diphosphonic acid, as well as 1-aminoalkane-1,1-diphosphonic acids having from 1 to 8 carbon atoms in the alkane moiety. Suitable phosphonocarboxylic acids include acids such as 2-phosphono-1,2,4-butanetricarboxylic acid and especially nitrilo-trimethylenephosphonic acid.

Suitable as tensides are alkylsulfonic acids with a chain length of from 8 to 18 carbon atoms in the alkyl moiety and/or alkylbenzene sulfonic acid with from 8 to 15 carbon atoms in the alkyl moiety and/or nonionic tensides such as products of from 8 to 15 mols of ethylene oxide onto alkylphenols with an alkyl moiety containing from 8 to 12 carbon atoms or onto fatty alcohols with from 8 to 18 carbon atoms.

Suitable solubilizers and/or solvents include aliphatic alcohols, particularly lower alkanols such as ethanol, propanol, isopropanol, and n-butanol. Compounds such as sodium isopropylbenezene sulfonate or isopropylbenzene sulfonic acid are also useful as solubilizers.

The addition to the acid solutions of liquid paraffin or silicone oils in small amounts as protecting component has proven to be advantageous in some cases. The described agents are applied in relatively concentrated aqueous solutions.

The cleaning solutions described above are applied in a thin film at ambient temperature to the anodized surface.

The application can be accomplished, for example, by spraying, but more advantageously by brushing, rolling on, or manual wiping. The cleaning solution is allowed to act for an adequate length of time and is then rinsed off with water. More specifically the cleaning solution is permitted to remain in contact with the anodized surface for a time sufficient to facilitate cleansing, such as, for example, from about 2 to 60 minutes, preferably from about 5 to 40 minutes. A significant advantage of the cleaning method described herein is that the solution can remain on the anodized surface for a relatively long time without causing noticeable corrosion of the aluminum oxide layer.

The thickness of the oxide coating on the anodized surfaces can vary to a large degree. However, typically the coatings will have a thickness of from about 5 to 50μ, preferably from about 10 to 35μ. More preferably, the coating thickness will be from about 15 to 25 μ.

The invention herein is useful for cleaning anodized surfaces of aluminum and alloys thereof. Such alloys include alloys of aluminum containing variable amounts of manganese, silicon, copper, magnesium, lead, bismuth, nickel, chronium, iron, zinc, or tin, such as, for example, aluminum brass or aluminum bronze.

The following examples are intended to illustrate the invention and should not be construed as limiting the invention thereto.

EXAMPLES

A. Testing Damage to Anodizes Surfaces Due to Acid Cleaning Agent Solutions

Light bronze-colored aluminum test sheets anodized by conventional methods and measuring 16×8 cm were used. The thicknesses of the oxide layers, which are recorded in Table 2 below, were from about 17 to 23μ. The aluminum sheets were immersed halfway in concentrated test solutions at 20° C. for 20 hours. The compositions of the test solutions are set forth in the following table:

TABLE 1

| Product: | A | B | C** | D | E | F | G** |
|---|---|---|---|---|---|---|---|
| Formulation (in wt. %): | | | | | | | |
| $HNO_3$ (65%) | 10 | 8 | 5 | 19.5 | 20 | 15 | 20 |
| Partial esters of phosphoric ester | 5 | 10 | 10 | 3.0 | 1 | 0.5 | — |
| Nitrilotrimethylene phosphonic acid | 5 | 0.5 | — | 5.0 | 10 | 0.5 | — |
| Alkylbenzene sulfonic acid | — | 2.5 | 5 | — | — | — | — |
| Nonylphenol polyglycol ether | 5 (15 EO)* | 10 (13 EO)* | — | — | 20 (7 EO)* | 5 (7 EO)* | — |
| Polyglycol ether of $C_{12}$-$C_{18}$-fatty alcohol | 5 (11 EO)* | — | 2 (15 EO)* | — | — | — | — |
| $C_{12}$-$C_{18}$-Alkylsulfonic acid | — | — | — | 10 | — | 10 | — |
| Isopropanol | 20 | — | 10 | — | — | 5 | — |
| Na—Isopropanol sulfonate | — | — | — | 3 | — | 2 | — |
| Distilled water | 50 | 69 | 71 | 64 | 49 | 62 | 80 |

*Number of ethylene oxide groups in the respective tenside.
**Comparison

In addition, an acid cleaner having the following composition:

| Component | Percent by Weight |
|---|---|
| Amidosulfonic acid | 10.0 |
| Ammonium hydrofluoride | 0.4 |
| Adduct of 15 mols of ethylene oxide onto nonylphenol | 10.0 |
| Water | 79.6 |

was used as a comparison test solution H. The aluminum sheets were only immersed in this test solution for one hour.

After immersion, the aluminum sheets were washed with water and examined for possible changes in color. The thickness of the anodic oxide layer, as well as the admittance, Y, and the dielectric loss factor, d, of the test surface, were also measured and compared with the untreated half of the test sheet. The results of the testing of products A to H is set forth in the table below.

TABLE 2

| Product | | Thickness of anodic oxide layer (μ) | Admittance, Y (μS) | Dielectric loss factor, d | Appearance of the immersed surfaces |
|---|---|---|---|---|---|
| A | untreated | 19 | 6 | 0.2 | unchanged |
| | immersed | 19 | 6 | 0.2 | |
| B | untreated | 17 | 7 | 0.2 | very little dulling |
| | immersed | 17 | 40 | 0.4 | no color change |
| C* | untreated | 18 | 6 | 0.2 | slight dulling |
| | immersed | 17 | 200 | 0.4 | no color change |
| D | untreated | 20 | 6 | 0.2 | unchanged |
| | immersed | 20 | 6 | 0.2 | |
| E | untreated | 18 | 6 | 0.2 | unchanged |
| | immersed | 18 | 6 | 0.2 | |
| F | untreated | 18 | 7 | 0.2 | unchanged |
| | immersed | 18 | 7 | 0.2 | |
| G* | untreated | 23 | 5 | 0.2 | unchanged |
| | immersed | 23 | 7 | 0.2 | |
| H* | untreated | 21 | 6 | 0.2 | completely dull |
| | immersed | 11 | 200 | 0.6 | bronze color removed |

*Comparison

B. Testing the Cleaning Action

The cleaning action of the test products A to G according to Table 1 was evaluated in a practical test carried out under standardized conditions and was compared with an abrasive cleanser having the following formulation:

| Component | Percent by Weight |
|---|---|
| Quartz kaolinite abrasive | 20 |
| Xylene | 15 |
| Cyclohexanol | 3 |
| Ethoxylate of fatty alcohol | 2 |
| Na—salt of alkylbenzene sulfonic acid | 3 |
| Water | 57 |
| | 100 |

An eloxal, that is, electrolytically oxidized aluminum, facade area appearing to be evenly and strongly soiled was subdivided into a series of three test areas measuring 1.50×50 cm each. The middle test area was cleaned as well as possible with the abrasive cleanser, which cleaned test area became the standard against which two acidic cleansers were tested. The undiluted cleansers according to the invention were applied evenly and without pressure to the test areas, a wiper saturated with the test solution being used, so that a thin, homogeneous cleaning film remained behind. After each cleanser was allowed to act for two minutes, it was washed off with a lambs wool wiper and liberal amounts of water, and the remaining moisture was removed with a rubber blade. The cleaning effect of the two test products was compared to the standard and evaluated by three testers grading independently according to the following scale:

| Evaluation | Points |
|---|---|
| better than standard | 1 |
| worse than standard | 0 |
| same as standard | 0.5 for standard and test product |

The tests were repeated on two additional facades of different colors. The maximum number of points that could be reached was thus 9 points. For point totals of 6 points or more, the test product was considered to grade better than the standard in the overall evaluation; for point totals of from 4 to 5.5 points, it was considered to grade the same; and for point totals below 4, it was considered to grade worse than the standard.

The results are set forth in the following table:

TABLE 3

| Product | Point Total |
|---|---|
| A | 7 |
| B | 6 |
| C* | 4 |
| D | 8 |
| E | 9 |
| F | 7 |
| G* | 3 |

*Comparison

The above results show the exceptionally good cleaning power of the products according to the invention. The combinations according to the invention, particularly Products D and E, demonstrated clearly superior results as compared to the single action of nitric acid (Product G). Table 2 shows that the fluoric acid product, comparison Product H, caused extremely strong damage after only one hour at 20° C., whereas the products according to the invention did not result in any serious changes on the anodic oxide layer even after 20 hours at 20° C.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. In a process for cleaning an anodized surface of aluminum or an alloy thereof where a cleaning agent is applied to the anodized surface and then the cleaning agent is removed after a sufficient period of contact, the improvement which comprises applying to the anodized surface at ambient temperature a thin film of a cleaning composition comprising an acid solution consisting essentially of:

(a) from about 3 to 30 percent by weight, based upon the total weight of the acid solution, of nitric acid, calculated as a 65% aqueous solution;

(b) from about 0.1 to 20 percent by weight, based upon the total weight of the acid solution, of partial esters of phosphoric acid;

(c) from about 0.3 to 30 percent by weight, based upon the total weight of the acid solution, of a phosphonic acid or phosphonocarboxylic acid with complexing action;

(d) from about 0.5 to 30 percent by weight, based upon the total weight of the acid solution, of nonionic and/or anionic tensides;

(e) from 0 to about 30 percent by weight, based upon the total weight of the acid solution, of solubilizers and/or organic solvents; and (f) from about 40 to 90 percent by weight, based upon the total weight of the acid solution, of water, said solution having a pH of less than 2, and then rinsing off the cleaning composition with water.

2. The process of claim 1, wherein component (a) comprises from about 5 to 20 percent by weight of nitric acid.

3. The process of claim 1, wherein component (b) comprises from about 0.2 to 10 percent by weight of partial esters of phosphoric acid.

4. The process of claim 1, wherein component (c) comprises from about 0.5 to 20 percent by weight of a phosphonic acid or phosphonocarboxylic acid with complexing action.

5. The process of claim 1, wherein component (d) comprises from about 1 to 20 percent by weight of tenside.

6. The process of claim 1, wherein component (e) comprises from 0 to about 20 percent by weight of solubilizers and/or solvent.

7. The process of claim 1, wherein component (f) comprises from about 49 to 80 percent by weight of water.

8. The process of claim 1, wherein the cleaning composition remains on the anodized surface for from about 2 to 60 minutes.

9. A cleansing composition for cleaning an anodized surface of aluminum or an alloy thereof which comprises an aqueous acid solution consisting essentially of:

(a) from about 3 to 30 percent by weight, based upon the total weight of the solution, of nitric acid, calculated as a 65% aqueous solution;

(b) from about 0.1 to 2 percent by weight, based upon the total weight of the acid solution, of partial esters of phosphoric acid;

(c) from about 0.3 to 30 percent by weight, based upon the total weight of the acid solution, of a phosphonic acid or phosphonocarboxylic acid with complexing action;

(d) from about 0.5 to 30 percent by weight, based upon the total weight of the acid solution, of nonionic and/or anionic tensides;

(e) from 0 to about 30 percent by weight, based upon the total weight of the acid solution, of solubilizers and/or organic solvents; and (f) from about 40 to 90 percent by weight, based upon the total weight of the acid solution, of water, said solution having a pH of less than 2.

10. The composition of claim 9, wherein component (a) comprises from about 5 to 20 percent by weight of nitric acid.

11. The composition of claim 9, wherein component (b) comprises from about 0.2 to 10 percent by weight of partial esters of phosphoric acid.

12. The composition of claim 9, wherein component (c) comprises from about 0.5 to 20 percent by weight of a phosphonic acid or phosphonocarboxylic acid with complexing action.

13. The composition of claim 9, wherein component (d) comprises from about 1 to 20 percent by weight of tenside.

14. The composition of claim 9, wherein component (e) comprises from 0 to about 20 percent by weight of solubilizers and/or solvent.

15. The composition of claim 9, wherein component (f) comprises from about 49 to 80 percent by weight of water.

* * * * *